United States Patent [19]

Scholz et al.

[11] Patent Number: 5,043,623

[45] Date of Patent: Aug. 27, 1991

[54] REFLECTOR LAMP ASSEMBLY INCLUDING METAL HALIDE ARC TUBE

[75] Inventors: John A. Scholz, Danvers; Robert S. White, Beverly, both of Mass.

[73] Assignee: GTE Products Corporation, Danvers, Mass.

[21] Appl. No.: 623,312

[22] Filed: Dec. 6, 1990

[51] Int. Cl.[5] ..... H01J 61/52

[52] U.S. Cl. ..... 313/25; 313/634

[58] Field of Search ..... 313/25, 634

[56] References Cited

U.S. PATENT DOCUMENTS 4,961,019 10/1990 White et al. ..... 313/25

*Primary Examiner*—Donald J. Yusko
*Assistant Examiner*—Diab Hamadi
*Attorney, Agent, or Firm*—Joseph S. Romanow

[57] ABSTRACT

An electric lamp includes an arc tube assembly mounted in a lamp envelope including a reflector, a lens and a base for connection to an electrical source. The arc tube assembly includes an arc tube having a longitudinal axis aligned with the optical axis of the reflector, a light-transmissive shroud disposed around the arc tube, first and second clips attached to opposite ends of the arc tube, a connection member attached to the first and second clips such that the shroud is retained between the first and second clips in a fixed position relative to the arc tube, and upper and lower electrode supports for mechanically supporting the arc tube in the lamp envelope entirely from the base region and for coupling electrical energy to the arc tube. A support ring is positioned in a heel region of the lamp envelope and is attached to the connection member. The support ring cushions the arc tube assembly when the lamp is subjected to mechanical shock. The connection member includes a connection rod having a first section located outside the shroud between the first and second clips and a second section extending between the first section and the support ring.

16 Claims, 2 Drawing Sheets

REFLECTOR LAMP ASSEMBLY INCLUDING METAL HALIDE ARC TUBE

FIELD OF THE INVENTION

This invention relates to electric lamps for general illumination and, more particularly, to electric lamps utilizing a metal halide arc tube mounted in a sealed reflector.

BACKGROUND OF THE INVENTION

Lamp assemblies incorporating reflectors are well known. Examples include spotlights and floodlights for indoor and outdoor use. A lamp is mounted in a sealed outer envelope which includes a reflecting interior surface, typically parabolic, for directing light in a preferred direction. The reflector is covered with a lens, and a base is provided for mounting the lamp assembly and for interconnection of the lamp assembly to an electrical energy source. Incandescent lamps, high-pressure sodium arc tubes and mercury arc tubes have been utilized in such lamp assemblies.

Recently, it has been proposed to utilize metal halide arc tubes in reflector lamp assemblies. Metal halide arc tubes provide excellent color, long life and high efficiency. Low wattage metal halide arc tube assemblies include an arc tube which encloses a suitable fill material such as sodium, scandium and mercury iodides. Electrodes are located within the arc tube at opposite ends, and electrode leads extend through press seals for connection to an electrical source. An example of a reflector lamp assembly utilizing a metal halide arc tube is disclosed in U.S. Pat. No. 4,961,019, issued Oct. 2, 1990 to White et al.

It has been found desirable to mount metal halide arc tubes within a light-transmissive quartz shroud or shield. The shroud produces a higher and more uniform arc tube temperature than would otherwise occur. The shroud is, in part, responsible for the excellent color temperature and the long operating life of metal halide arc lamps. In addition, it is known that metal halide arc tubes are subject to burst on rare occasions. The shroud contains shards of the arc tube when the burst occurs.

When a metal halide arc tube is mounted in a reflector, several requirements must be met. It is preferred, in order to maximize light output, that the axis of the arc tube be aligned with the optical axis of the reflector and that the center of light output of the arc tube coincide with the focal point of the reflector. The mounting arrangement for the arc tube must provide means for mounting both the shroud and the arc tube. The arc tube and the shroud must be securely mounted within the lamp envelope to prevent damage during shipping and handling.

In conventional arc discharge lamps which utilize a bulbous lamp envelope, the arc tube and shroud are mechanically supported from both ends of the lamp envelope. However, the process of fabricating a reflector lamp assembly involves heating steps which cause the reflector to sag under the weight of the lens. Later in the process, a pressurized gas is introduced into the lamp envelope in order to raise the lens to a desired height. This variation in dimensions during processing precludes the mount assembly for the arc tube and shroud from being secured to the lens.

It is well known that conductors located in proximity to an arc discharge tube containing sodium cause sodium migration, or sodium electrolysis. Sodium ions migrate through the wall of the arc tube and thereby reduce the life of the lamp. It has been found desirable to keep conducting frame members and power leads away from the arc tube to the extent possible. In prior lamp assemblies which do not include a reflector, a frameless construction has been utilized in which a fine wire connects the arc tube electrode at the dome end of the lamp to the electrical feedthrough at the base end of the lamp. The arc tube is maintained in position by bulb spacers at the base and dome ends of the lamp envelope. The electrically-isolated floating frame develops a positive charge which inhibits the migration of sodium ions through the arc tube. As noted above, a double-ended mechanical mount is not feasible in a reflector lamp assembly.

It is a general object of the present invention to provide improved reflector lamp assemblies.

It is another object of the present invention to provide reflector lamp assemblies which utilize metal halide arc discharge tubes.

It is a further object of the present invention to provide a metal halide reflector lamp assembly having a long operating life.

It is a further object of the present invention to provide a lamp assembly, including a metal halide arc tube and a light-transmissive shroud, suitable for mounting in a reflector.

It is yet another object of the present invention to provide a metal halide lamp assembly wherein all conductive parts except the electrical inleads are electrically isolated.

It is yet another object of the present invention to provide a metal halide reflector lamp assembly that is compatible with automatic assembly equipment.

It is still another of the present invention to provide a metal halide reflector lamp assembly that is capable of withstanding mechanical shock and vibration during routine shipping and handling.

It is a further object of the present invention to provide a lamp assembly, including a metal halide arc tube mounted in a reflector, that is easily manufactured and low in cost.

SUMMARY OF THE INVENTION

According to the present invention, these and other objects and advantages are achieved in an electric lamp comprising a lamp envelope having a base region including a base for connection to an electrical source, an arc tube having an upper electrode lead and a lower electrode lead extending from opposite ends thereof, a light-transmissive shroud disposed around the arc tube, the shroud having a cylindrical, open-ended configuration, first and second clips attached to opposite ends of the arc tube, each of the clips including a portion for retaining the shroud, a connection member attached to the first and second clips such that the shroud is retained between the first and second clips in a fixed position relative to the arc tube, the connection member being unattached to the lamp envelope, and support means for mechanically supporting the arc tube in the lamp envelope entirely from the base region of the lamp envelope and for coupling electrical energy to the arc tube.

The lamp preferably includes a support ring attached to the connection member for limiting radial movement of the arc tube and the shroud relative to the lamp envelope when the lamp is subjected to mechanical shock. In a preferred embodiment, the connection member comprises a connection rod having a first section located outside the shroud between the first and second clips and a second section extending between the first section and the support ring. The support ring preferably has an outside diameter that is slightly less than the inside diameter of the lamp envelope adjacent to the support ring.

In a preferred embodiment, the first and second clips each include a strap having inturned ends. An arcuate portion is affixed to one of the inturned ends, and a tab is affixed to the other of the inturned ends. The arcuate portion encircles a portion of the shroud, and the tab is attached to the connection member. The first and second clips each further include projections for retaining the arc tube.

The support means preferably comprises an upper electrode support coupled to the upper electrode lead of the arc tube and extending outside the shroud to the base, and a lower electrode support coupled to the lower electrode lead of the arc tube and extending to the base. The upper and lower electrode supports provide mechanical support of the arc tube in the lamp envelope and carry electrical energy to the arc tube.

BRIEF DESCRIPTION OF THE DRAWING

For a better understanding of the present invention, together with other and further objects, advantages and capabilities thereof, reference is made to the accompanying drawings which are incorporated herein by reference and in which.

DETAILED DESCRIPTION OF THE INVENTION

Figure 1:
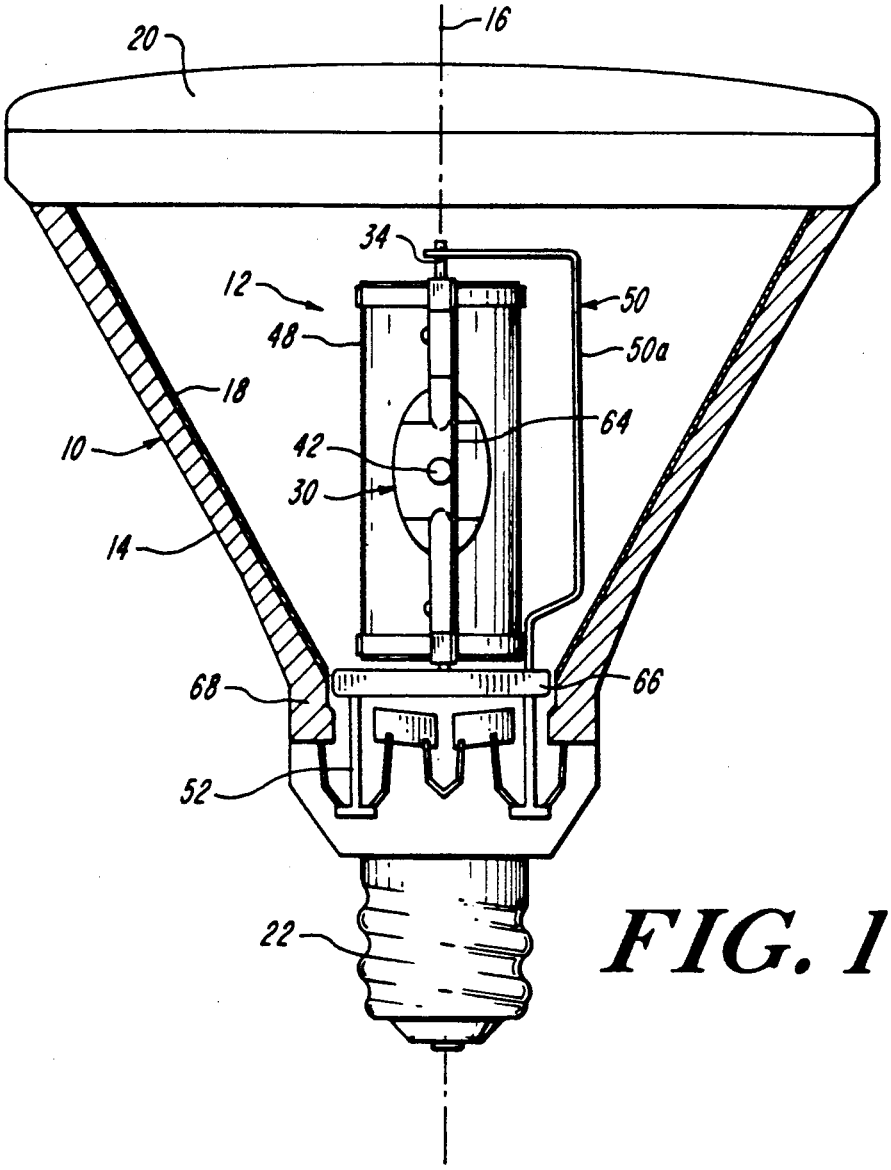
FIG. 1 is an elevational view, partly in cross-section, of a reflector lamp in accordance with the present invention.
Figure 2:
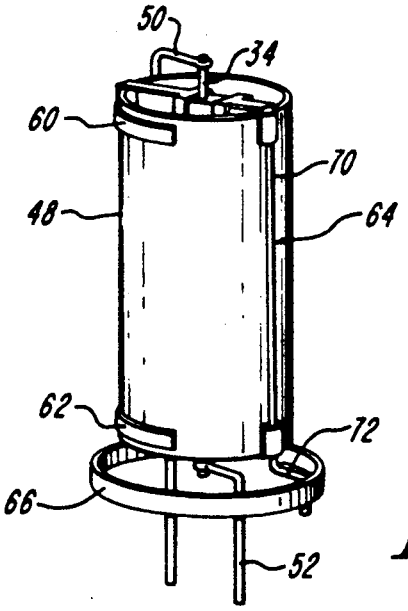
FIG. 2 is a perspective view showing the arc tube assembly of the lamp shown in FIG. 1.
Figure 3:
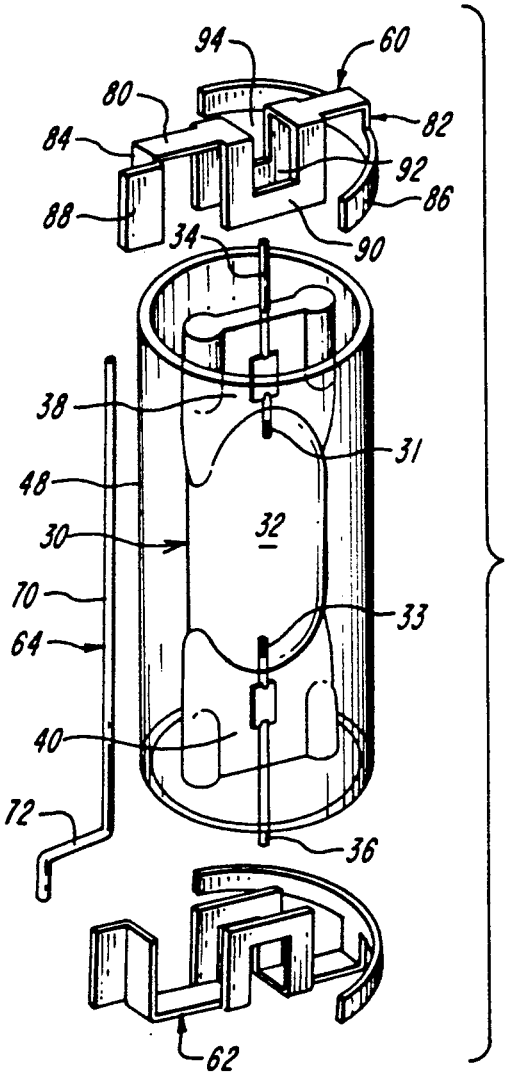
FIG. 3 is an exploded view showing the arc tube, shroud, clips and connection member of the lamp shown in FIG. 1.

An electric lamp in accordance with the present invention is shown in FIG. 1. Detailed views of the arc tube assembly are shown in FIGS. 2 and 3. A lamp envelope 10 provides a sealed enclosure for an arc tube assembly 12. The lamp envelope 10 includes a reflector 14 having circular symmetry about an optical axis 16. A reflecting surface 18 on the interior surface of reflector 14 typically has a parabolic shape. The reflecting surface 18 can be an aluminum coating, a dichroic reflector or any other suitable reflector. Reflector 14 is closed by a lens 20. A base 22 provides a means for supplying electrical energy to the arc tube assembly 12 and for mounting of the lamp. Typically, the lamp envelope 10 is filled with nitrogen at a pressure of approximately 400 torr. An electric lamp of the type shown in FIG. 1 is typically utilized as a downlight, a spotlight, or a floodlight for indoor or outdoor illumination.

The arc tube assembly 12 includes an arc tube 30. The arc tube 30 is typically a low-wattage metal halide lamp such as a type M100 manufactured and sold by GTE Products Corporation. Arc tube 30 encloses a discharge region 32 containing a fill material such as sodium, scandium and mercury iodides, and argon at a pressure of 100 torr. Electrodes 31 and 33 are located at opposite ends of the arc tube 30 and are coupled to external electrode leads 34 and 36 through press seals 38 and 40, respectively.

The arc tube 30 is mounted in lamp envelope 10 with its longitudinal axis on the optical axis 16 of reflector 14. Preferably, a light center 42 of arc tube 30 is positioned at the focal point of reflecting surface 18 for maximum light output in the desired direction The arc tube 30 is positioned within a light-transmissive shroud 48. The shroud 48 is typically fabricated of quartz and comprises a right circular cylinder that is open at both ends. Shroud 48 provides a higher and more uniform temperature during operation of arc tube 30 than would otherwise occur without the shroud. The shroud 48 is, in part, responsible for the excellent color temperature and the long operating life of metal halide arc tubes. In addition, the shroud 48 provides a containment function in the rare event of an arc tube burst. The shroud 48 absorbs energy from shards of the arc tube 30. Although the shroud 48 may be shattered by a burst arc tube, the energy of the burst is partially absorbed so that the shards are completely contained within the lamp envelope 10. Shroud 48 preferably has a wall thickness of approximately one to three millimeters.

The mounting structure for the arc tube 30 and the shroud 48 includes an upper electrode support 50 attached to electrode lead 34 and a lower electrode support 52 attached to electrode lead 36. The electrode supports 50 and 52 mechanically support the arc tube 30 within lamp envelope 10 and carry electrical energy to arc tube 30. Upper electrode support 50 extends transversely from electrode lead 34 and then extends downwardly outside shroud 48 to the base region of the lamp. Preferably, a section **50*a* of electrode support 50 is spaced as far as is practical from the outside surface of shroud 48 in order to minimize sodium migration which can be caused by the presence of a conducting surface in proximity to arc tube 30. Lower electrode support 52 extends transversely from electrode lead 36 and then downwardly to the base region of the lamp. The downwardly-extending portions of the electrode supports 50 and 52 are preferably located on opposite sides of the base region of the lamp envelope 10 and are welded to electrode leads 34 and 36**, respectively.

The mounting structure for arc tube 30 and shroud 48 further includes an upper clip 60 and a lower clip 62 which secure arc tube 30 and shroud 48 to a connection rod 64. A support ring 66 is located in a heel region 68 of the lamp envelope 10 and is attached to connection rod 64. The connection rod 64 includes a first section 70 located outside shroud 48 and attached between upper clip 60 and lower clip 62. The connection rod 64 further includes a second section 72 that extends between lower clip 62 and support ring 66. The first section 70 is generally parallel to optical axis 16, and second section 72 is offset in a generally radial direction.

Each of the clips 60 and 62 is preferably formed as an integral metal element including a strap 80 having inturned ends 82 and 84. An arcuate portion 86 is affixed to inturned end 82, and a tab 88 is affixed to inturned end 84. The arcuate portion 86 encircles a portion of the circumference of shroud 48. The strap 80 passes over and bears against the end of shroud 48. The spacing between inturned ends 82 and 84 is the same or slightly larger than the outside diameter of shroud 48 so that shroud 48 is retained between inturned end 84 and arcuate portion 86. Tab 88 is preferably welded to connection member 64. The strap 80 is provided with spaced apart projections 90 and 92 for retaining arc tube 30 between them. In a preferred embodiment, the projections 90 and 92 are generally U-shaped portions which are perpendicular to strap 80. The projections 90 and 92 are spaced to receive the press seal 38 of arc tube 30. The strap 80 includes an opening 94 of sufficient size to provide clearance for electrode lead 34. Clips of the type shown in FIG. 3 are disclosed in U.S. application Ser. No. 07/539,752 filed June 18, 1990.

In one example, the connection rod 64 is nickel-plated steel having a diameter of 0.050-inch. The support ring 66 can be fabricated from any relatively rigid material. In one example, a strip of nickel 0.125-inch wide and 0.010-inch thick was used to form the support ring 66. The support ring 66 is positioned in the heel region 68 of the lamp envelope 10. Preferably, the outside diameter of support ring 66 is slightly less than the inside diameter of heel region 68. With this arrangement, the lamp can be assembled using automatic assembly equipment. When the lamp is subjected to mechanical shock during shipping and handling, the support ring 66 comes into contact with heel region 68 and cushions the arc tube assembly 12. The support ring 66 prevents the arc tube assembly 12 from being damaged or dislocated from its normal position in lamp envelope 12. In a preferred embodiment of the support ring 66, a strip of nickel 0.125-inch wide and 0.010-inch thick is used to form a two-layer support ring. Where the two layers overlap, the support ring includes three layers. At the overlap region, the support ring 66 is welded to the offset portion 72 of the connection rod 64.

The upper clip 60, lower clip 62, connection rod 64 and support ring 66 are mechanically and electrically isolated from upper electrode support 50 and lower electrode support 52. The upper and lower electrode supports 50 and 52 are attached to the base of the lamp as described in the aforementioned U.S. Pat. No. 4,961,019.

While there have been shown and described what are at present considered the preferred embodiments of the present invention, it will be obvious to those skilled in the art that various changes and modifications may be made therein without departing from the scope of the invention as defined by the appended claims.

What is claimed is:

1. An electric lamp comprising:

a lamp envelope having a base region including a base for connection to an electrical source;

an arc tube having an upper electrode lead and a lower electrode lead extending from opposite ends thereof;

a light-transmissive shroud disposed around said arc tube, said shroud having a cylindrical, open-ended configuration;

first and second clips attached to opposite ends of said arc tube, each of said clips including a portion for retaining said shroud;

a connection member attached to said first and second clips such that said shroud is retained between said first and second clips in a fixed position relative to said arc tube, said connection member being unattached to said lamp envelope; and support means for mechanically supporting said arc tube in said lamp envelope entirely from the base region of said lamp envelope and for coupling electrical energy to said arc tube.

2. An electric lamp as defined in claim 1 further including a support ring attached to said connection member.

3. An electric lamp as defined in claim 1 wherein said first and second clips each include a strap having inturned ends, an arcuate portion affixed to one of said inturned ends and a tab affixed to the other of said inturned ends, said arcuate portion encircling a portion of the shroud, said tab being attached to said connection member, said first and second clips each further including spaced-apart projections for retaining said arc tube.

4. An electric lamp as defined in claim 1 wherein said connection member comprises a connection rod located outside said shroud between said first and second clips.

5. An electric lamp as defined in claim 1 wherein said arc tube comprises a metal halide arc tube having press seal regions at opposite ends thereof.

6. An electric lamp as defined in claim 1 wherein said lamp envelope includes a reflecting interior surface for redirecting light from said arc tube and a lens enclosing one end thereof.

7. An electric lamp as defined in claim 2 wherein said support ring has an outside diameter that is slightly less than the inside diameter of said lamp envelope adjacent to said support ring.

8. An electric lamp as defined in claim 2 wherein said connection member comprises a connection rod having a first section located outside said shroud between said first and second clips and a second section extending between said first section and said support ring.

9. An electric lamp as defined in claim 1 wherein said support means comprises:

an upper electrode support coupled to the upper electrode lead of said arc tube and extending outside said shroud to said base; and a lower electrode support coupled to the lower electrode lead of said arc tube and extending to said base, said upper and lower electrode supports providing mechanical support of said arc tube in said lamp envelope and coupling electrical energy to said arc tube.

10. An electric lamp as defined in claim 9 wherein said upper electrode support is spaced from an outer surface of said shroud.

11. An electric lamp as defined in claim 1 further including a support ring positioned in a heel region of said lamp envelope and having an outside diameter that is less than the inside diameter of said heel region, said support ring being attached to said connection member so as to cushion said arc tube and said shroud when the lamp is subjected to mechanical shock.

12. An electric lamp as defined in claim 2 wherein said support ring is positioned between a lower end of said shroud and said base region.

13. An electric lamp comprising:

a lamp envelope including a reflecting surface having an optical axis, a lens and a base region, said base region including a base for connection to an electrical source;

an arc tube having a longitudinal axis aligned with said optical axis, said arc tube including an upper electrode lead extending from a lens end and a lower electrode lead extending from a base end;

a light-transmissive shroud disposed around said arc tube, said shroud comprising an open-ended cylinder;

first and second clips attached to opposite ends of said arc tube, each of said clips including a portion for retaining said shroud;

a connection member attached to said first and second clips such that said shroud is retained between said first and second clips in a fixed position relative to said arc tube, said connection member being unattached to said lamp envelope;

a support ring attached to said connection member and positioned in a heel region of said lamp envelope;

an upper electrode support coupled to the upper electrode lead of said arc tube and extending outside said shroud to said base; and a lower electrode support coupled to the lower electrode lead of said arc tube and extending to said base, said upper and lower electrode supports providing mechanical support of said arc tube in said lamp envelope and coupling electrical energy to said arc tube.

14. An electric lamp as defined in claim 13 wherein said support ring has an outside diameter that is slightly less than inside diameter of lamp envelope adjacent to said support ring.

15. An electric lamp as defined in claim 13 wherein said connection member comprises a connection rod having a first section located outside said shroud between said first and second clips and a second section between said first section and said support ring.

16. An electric lamp as defined in claim 13 wherein said arc tube comprises a metal halide arc tube having press seal regions at opposite ends thereof.

* * * * *